US007152275B2

(12) United States Patent
Hitzelberger et al.

(10) Patent No.: US 7,152,275 B2
(45) Date of Patent: Dec. 26, 2006

(54) DIRT CONTAINER FOR CYCLONIC VACUUM CLEANER

(75) Inventors: J. Erik Hitzelberger, Danville, KY (US); Danielle M. Hafling, Lancaster, KY (US); Amy N. Mudd, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 503 days.

(21) Appl. No.: 10/616,038

(22) Filed: Jul. 9, 2003

(65) Prior Publication Data

US 2004/0010885 A1 Jan. 22, 2004

Related U.S. Application Data

(60) Provisional application No. 60/396,976, filed on Jul. 18, 2002.

(51) Int. Cl.
*A47L 9/16* (2006.01)
*B01D 45/16* (2006.01)

(52) U.S. Cl. ..... 15/352; 15/353; 55/337; 55/426; 55/429

(58) Field of Classification Search ..... 15/327.1, 15/327.2, 327.7, 347, 350–353, 327.6; 55/337, 55/424, 426, 429
See application file for complete search history.

(56) References Cited

U.S. PATENT DOCUMENTS 2,467,408 A * 4/1949 Semon ..... 55/325
2,894,600 A * 7/1959 Veres ..... 55/335
3,543,325 A * 12/1970 Hamrick ..... 15/314
4,643,748 A 2/1987 Dyson
4,724,574 A 2/1988 Bowerman et al.
5,078,761 A 1/1992 Dyson
5,096,475 A 3/1992 Kasper et al.
5,307,538 A 5/1994 Rench et al.
5,950,274 A 9/1999 Kilstrom
6,012,200 A 1/2000 Murphy et al.
6,070,291 A * 6/2000 Bair et al. ..... 15/347
6,108,864 A 8/2000 Thomas et al.
6,113,663 A 9/2000 Liu
6,228,151 B1 5/2001 Conrad et al.
6,228,260 B1 * 5/2001 Conrad et al. ..... 210/304
6,231,649 B1 5/2001 Dyson et al.
6,260,234 B1 7/2001 Wright et al.
6,269,518 B1 8/2001 Yung
6,436,160 B1 * 8/2002 Stephens et al. ..... 55/337
6,558,453 B1 * 5/2003 Sepke et al. ..... 95/268
6,599,350 B1 * 7/2003 Rockwell et al. ..... 96/135
6,757,933 B1 * 7/2004 Oh et al. ..... 15/353
6,829,804 B1 * 12/2004 Sepke ..... 15/347
2002/0029436 A1 * 3/2002 Hawkins et al. ..... 15/339
2004/0034962 A1 * 2/2004 Thur et al. ..... 15/353

FOREIGN PATENT DOCUMENTS

FR 998157 1/1952

* cited by examiner

*Primary Examiner*—Terrence R. Till
(74) *Attorney, Agent, or Firm*—King & Schickli, PLLC

(57) ABSTRACT

A vacuum cleaner has a housing including a nozzle assembly and a canister assembly. A dirt container is connected to the housing. The dirt container includes a collection chamber and a combined handle and inlet flow passageway. An airstream conduit conveys a vacuum airstream from the nozzle to the inlet flow passageway. A fan and motor assembly generates the vacuum airstream.

11 Claims, 5 Drawing Sheets

DIRT CONTAINER FOR CYCLONIC VACUUM CLEANER

This application claims the benefit of U.S. Provisional Patent Application Ser. No. 60/396,976 filed Jul. 18, 2002.

TECHNICAL FIELD

The present invention relates generally to the vacuum cleaner art, and, more particularly, to a vacuum cleaner incorporating a novel dirt container.

BACKGROUND OF THE INVENTION

Over recent years upright vacuum cleaners incorporating a removable dirt cup or dirt container have enjoyed increasing popularity. Such vacuum cleaners generally incorporate a nozzle assembly which rides on wheels over the floor surface to be cleaned. A canister assembly is pivotally mounted to the nozzle assembly. The canister assembly includes an operating handle that is manipulated by an operator to move the vacuum cleaner back and forth across the floor. The canister assembly also includes a cavity which holds the removable dirt container. That dirt container usually provides for cyclonic cleaning action.

In most upright vacuum cleaners sold today, a rotary agitator is provided in the main inlet cavity of the nozzle assembly. The rotary agitator includes tufts of bristles, brushes, beater bars or the like to beat dirt and debris from the nap of a carpet being cleaned. Simultaneously, the pressure drop or vacuum generated by a fan and motor arrangement carried in either the nozzle or canister assembly forces air entrained with this dirt and debris into the nozzle of the vacuum cleaner and delivers it to the dirt container. The dirt container traps this dirt and debris and the fan and motor arrangement then exhaust clean air into the environment.

The present invention relates to an improved dirt container for a vacuum cleaner. That dirt container includes a combined handle and inlet flow passageway and a unique prefilter which provides for more efficient airflow and better cleaning action.

SUMMARY OF THE INVENTION

In accordance with the purposes of the present invention as described herein, an improved vacuum cleaner is provided. That vacuum cleaner comprises a housing including a nozzle assembly and a canister assembly. A dirt container is connected to the housing. The dirt container includes a collection chamber and a combined handle and inlet flow passageway. An airstream conduit connected to the housing conveys a vacuum airstream from the nozzle assembly to the inlet flow passageway. A fan and motor assembly connected to the housing generates the vacuum airstream and draws dirt and debris through the airstream conduit and the inlet flow passageway into the collection chamber.

The inlet flow passageway includes an intake port in communication with the airstream conduit and a delivery port in communication with the collection chamber. The collection chamber is substantially cylindrical in shape and the delivery port is oriented substantially tangentially with respect to the collection chamber in order to provide for vortex airflow and cyclonic cleaning action.

In accordance with a further aspect of the present invention, the dirt container includes a filter and a discharge outlet. Additionally, the dirt container includes a prefilter extending at least partially across the collection chamber between the filter and the floor of the dirt container. The prefilter includes at least one airflow passageway in the face of the prefilter between inner and outer edges thereof.

Advantageously, the combined handle and inlet flow passageway allows the manufacturer to construct the dirt container from less material so that it is less expensive to produce and has a reduced overall weight. The handle also allows the operator to easily hold and manipulate the dirt container when the container is removed from the vacuum cleaner for emptying and reconnected to the vacuum cleaner for vacuum cleaner operation. The prefilter provides a number of important functions including retention of heavier dirt and debris in the lower portion of the dirt cup out of the main cyclonic airstream and efficient direction of airflow through the dirt container so as to increase vacuum cleaner operating efficiency.

In the following description there is shown and described one possible embodiment of the invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present invention, an embodiment of which is illustrated in the accompanying drawing

DETAILED DESCRIPTION OF THE INVENTION

Figure 1:
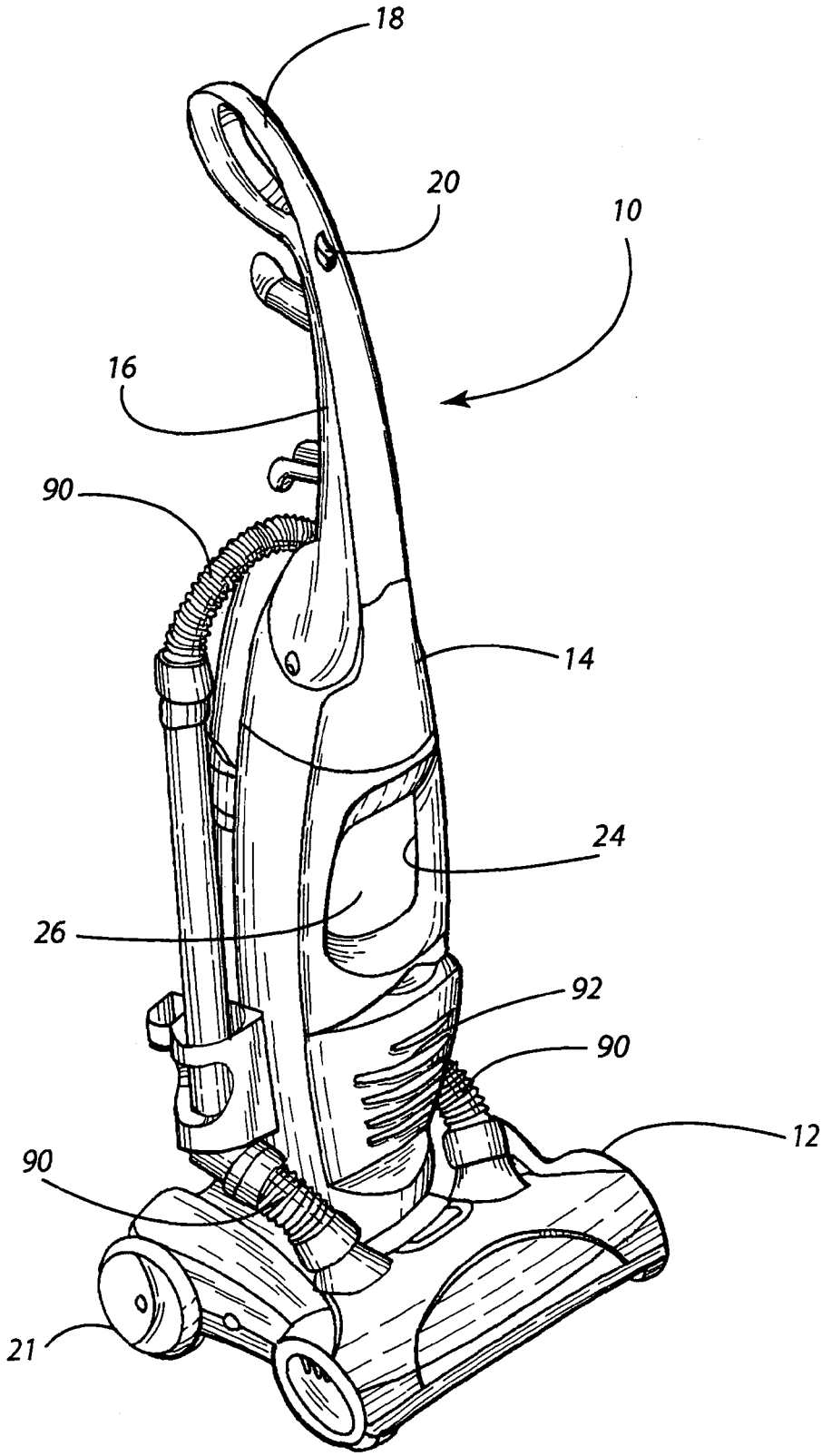
FIG. 1 is a perspective view of a vacuum cleaner of the present invention.
Figure 2:
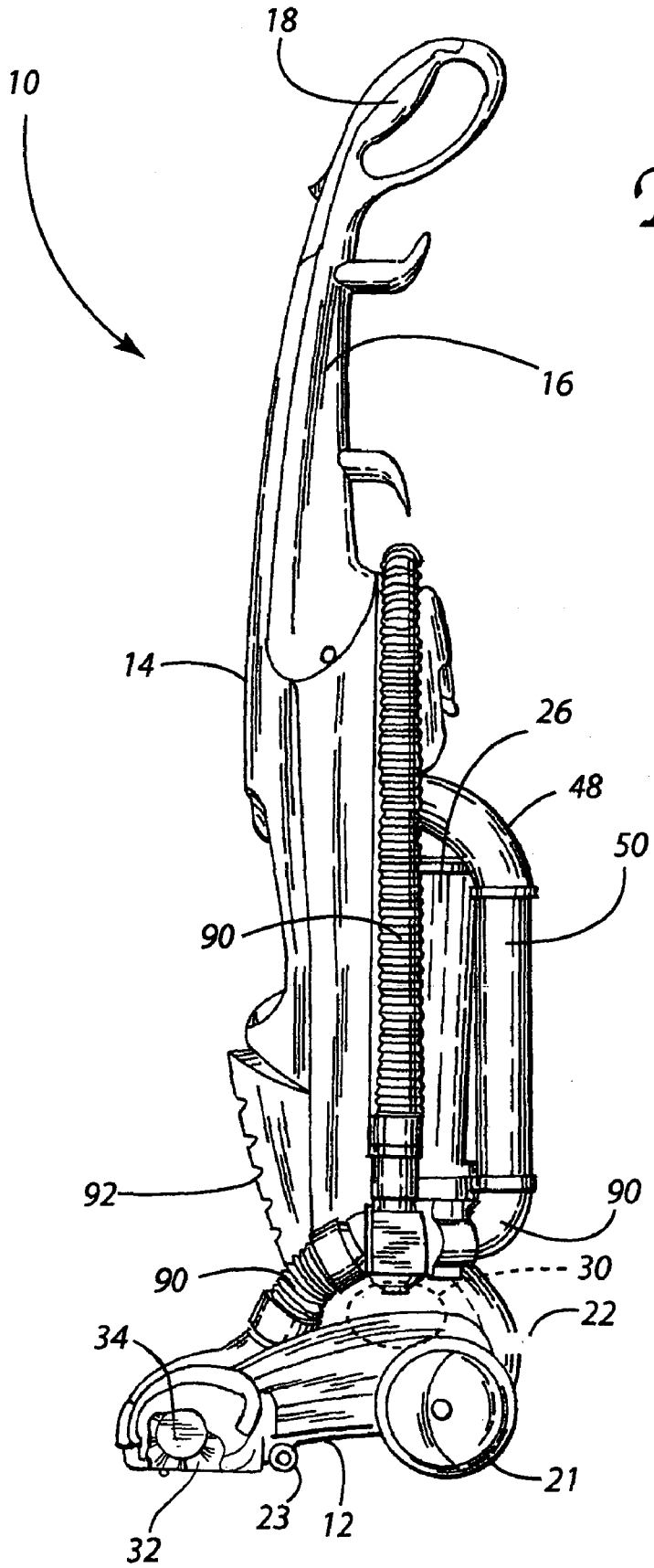
FIG. 2 is a side elevational view of the vacuum cleaner.

Reference is now made to drawing FIGS. 1 and 2 illustrating an upright vacuum cleaner 10 of the present invention. The upright vacuum cleaner 10 includes a housing comprising a nozzle assembly 12 and a canister assembly 14. The canister assembly 14 further includes a control handle 16 and a hand grip 18. A control switch 20 is provided for turning the vacuum cleaner on and off. Of course, electrical power is supplied to the vacuum cleaner 10 from a standard electrical wall outlet through a cord (not shown).

A first pair of wheels 21 (only one shown in FIG. 2) and a second pair of wheels 23 (only one shown in FIG. 2) provided on the nozzle assembly 12 function together to support the vacuum cleaner 10 for movement across the floor. To allow for convenient storage of the vacuum cleaner 10, a foot latch 22 functions to lock the canister assembly 14 in an upright position as shown in FIG. 1. When the foot latch 22 is released, the canister assembly 14 may be pivoted relative to the nozzle assembly 12 in a manner well known in the art as the vacuum cleaner 10 is manipulated back and forth to clean the floor.

Figure 3:
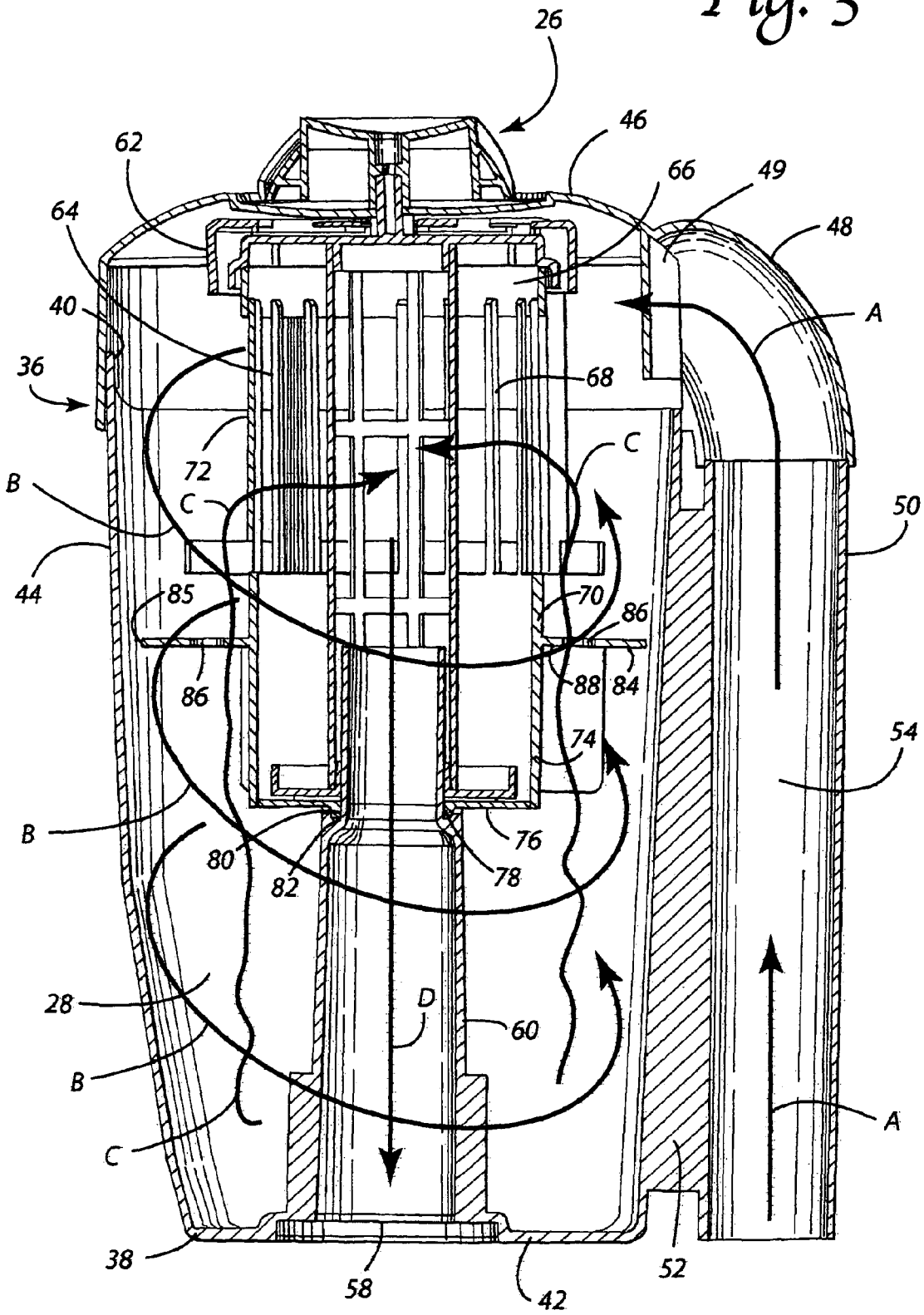
FIG. 3 is a schematical cross-sectional view of the dirt container of the vacuum cleaner shown in FIGS. 1 and 2.
Figure 4:
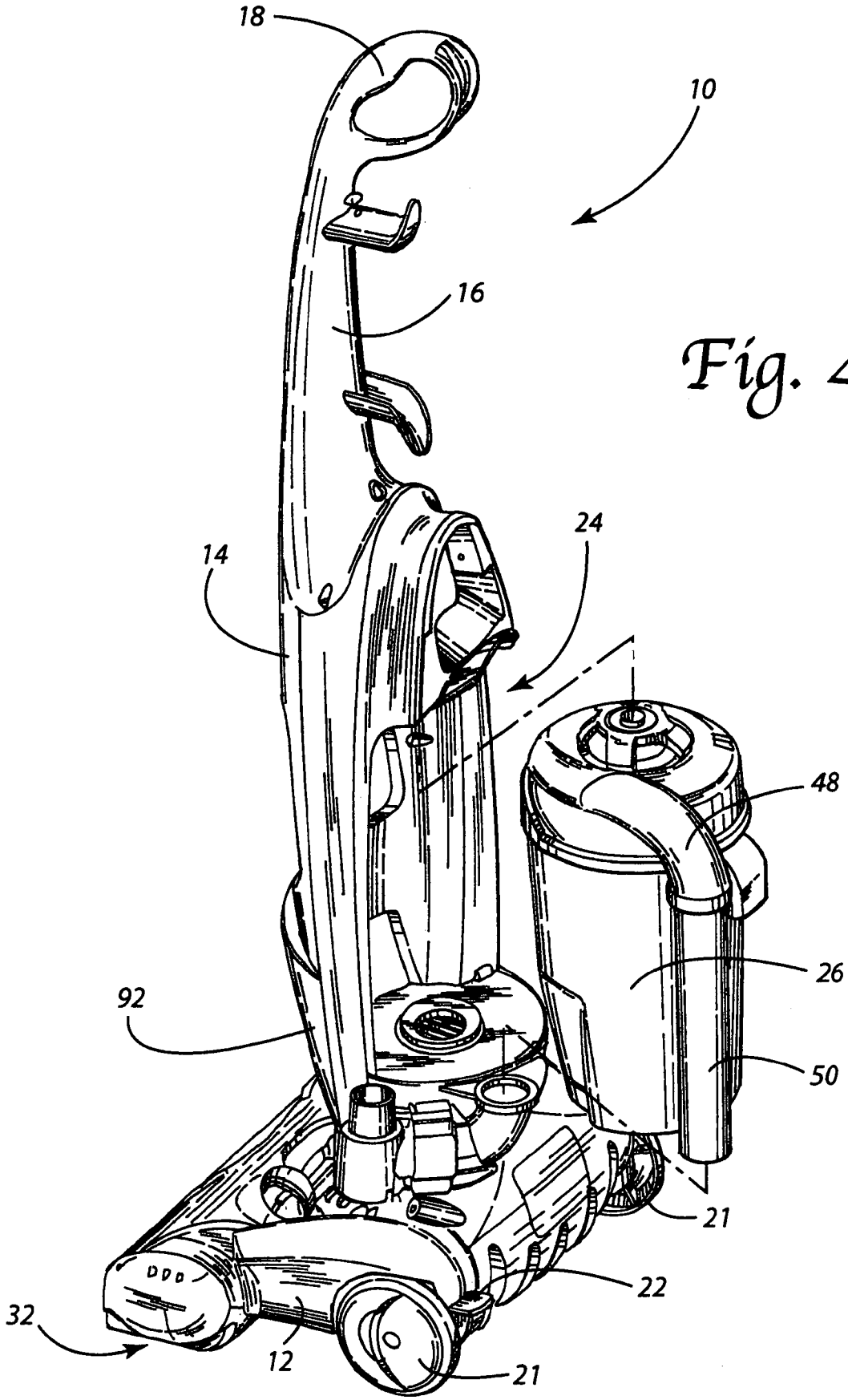
FIG. 4 is a rear perspective view of the vacuum cleaner, partially exploded to show the cavity for receiving the dirt container, and the dirt container removed therefrom.

The canister assembly 14 includes a cavity 24 (see also FIG. 4) adapted to receive and hold a dirt container 26 which includes a collection chamber 28 (see also FIG. 3). A suction fan and drive motor assembly 30 carried on the canister assembly 14 functions to generate a vacuum airstream for drawing dirt and debris from a surface to be cleaned. While the suction fan and drive motor assembly 30 is illustrated as being carried on the canister assembly 14, it should be appreciated that it could likewise be carried on the nozzle assembly 12 if desired.

The nozzle assembly 12 includes a main inlet cavity 32 that houses an agitator 34. The agitator 34 is rotated by the motor of the fan and drive motor assembly 30 or a separate agitator drive motor relative to the nozzle assembly 12. In the illustrated vacuum cleaner 10, the scrubbing action of the rotary agitator 34 and the negative air pressure created by the fan and drive motor assembly 30 cooperate to brush and beat dirt and debris from the nap of a carpet being cleaned and then draw the dirt and dust laden air from the inlet cavity 32 to the dirt container 26.

Figure 5:
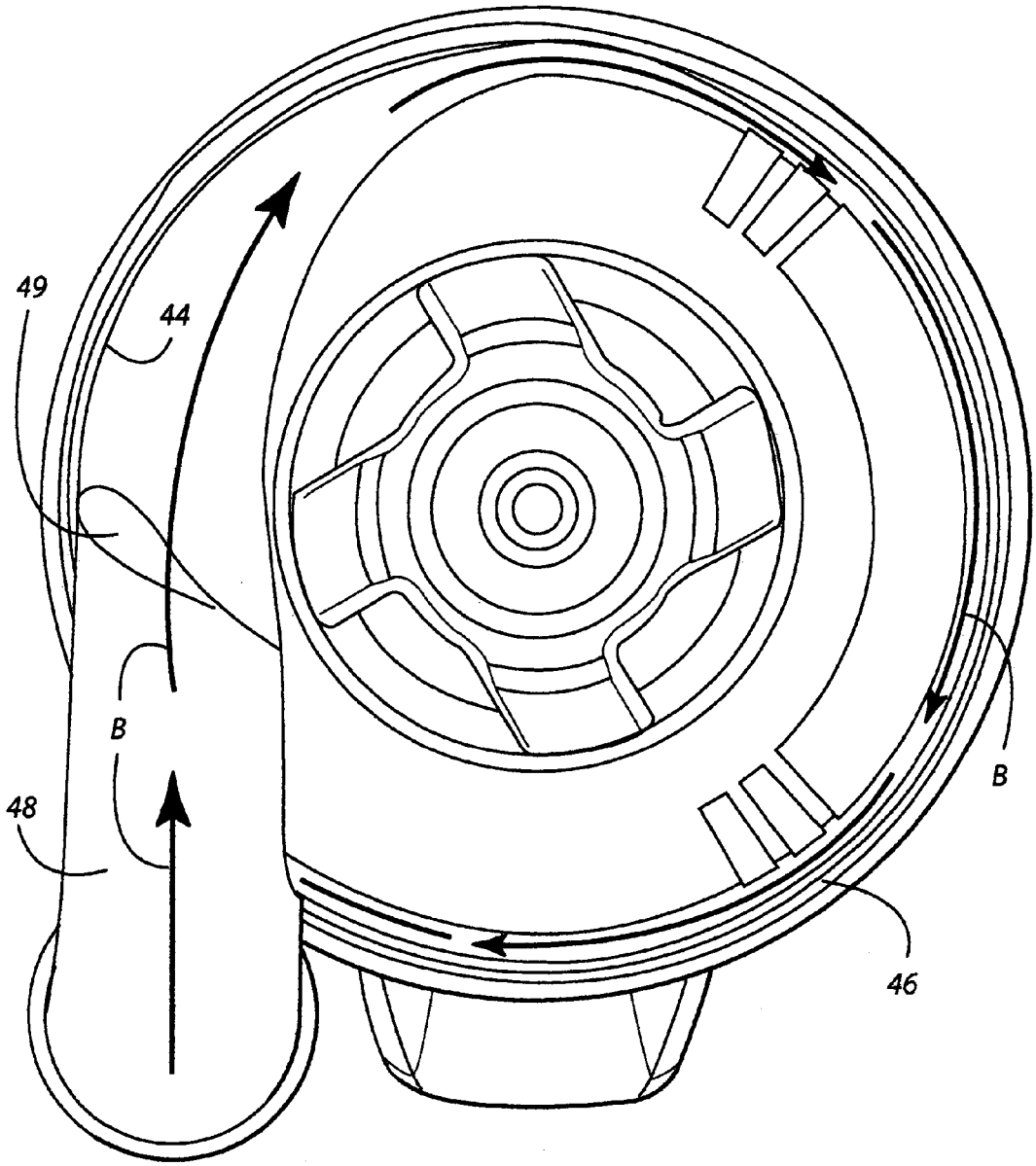
FIG. 5 is a top plan view of the dirt container of the vacuum cleaner shown in FIGS. 1, 2, and 4, illustrating the path of travel around the dirt container of an airstream containing entrained dirt and debris.

The dirt container 26 will now be described in detail. The dirt container 26 includes a filtering subassembly generally designated by reference numeral 36 and a container body 38. The container body 38 includes an open top 40, a bottom wall 42 and a generally cylindrical sidewall 44. The open top 40 of the container body 38 is closed by a cooperating lid 46. The lid 46 includes an inlet elbow 48 forming a delivery port 49 which opens tangentially along the lid 46 and sidewall 44 of the container body 38. In this orientation, as shown in greater detail in FIG. 5, the delivery port 49 promotes the formation of a vortex airstream within the collection chamber 28 of the dirt container 26.

A handle 50 is secured to the outer surface of the sidewall 44 by means of a relatively thin web 52 of material. The handle 50 is tubular and includes an internal passageway 54. When the lid 46 is properly seated on the container body 38 to close the open top 40, the delivery port 49 of the inlet elbow 48 is in fluid communication with the internal passageway 54 of the handle 50 and together, the port and passageway 49, 54 define an inlet flow passageway leading to the collection chamber 28.

A discharge port 58 is provided in the bottom wall 42 of the container body 38. A discharge conduit 60 is connected to the discharge port 58. The discharge conduit 60 extends inwardly into the container body 38 so that the lowermost portion of the collection chamber 28 is annular in cross section.

The filter assembly 36 includes a filter mounting bracket 62 connected to the lid 46. The filter assembly 36 also includes a filter 64 that is releasably secured to and held in the mounting bracket 62. The filter 64 includes a substantially cylindrical support frame 66 that is sized and shaped to be concentrically received in the dirt container 26. As illustrated, the support frame 66 includes a first relatively open section 68 and a second closed section 70. The open section 68 is covered by a pleated filter material 72 such as an ePTFE membrane bonded to a non-woven polyester support layer. The membrane has thousands of tiny fibrils formed into a continuous sheet. This sheet is about 50% porous or more with 50% of the pores having nominal diameters of about 5 microns or less. This media uses "surface filtration" to trap dirt and fine particles and is easy to clean.

The closed section 70 includes a cylindrical sidewall 74 and a bottom wall 76. The bottom wall 76 includes a central opening 78 that is sized and shaped to fit over or concentrically around the end of the discharge conduit 60. A sealing lip 80 provided on the bottom wall 76 about the margin of the opening 78 is received in a groove 82 formed around the discharge conduit 60 so as to provide a relatively airtight seal.

A prefilter 84 projects outwardly from the cylindrical sidewall 74 of the closed section 70 toward the sidewall 44 of the dirt container 26. A gap of between about 10 mm-30 mm is provided between the outer edge 85 of the prefilter 84 and the sidewall 44. At least one and preferably several airflow passageways 86 are provided in the face 88 of the prefilter 84 between the inner and outer edges thereof.

In operation the rotating agitator 34 beats the underlying rug or carpet loosening dirt and debris. That dirt and debris is swept up into the airstream drawn into the main inlet cavity 32 of the vacuum cleaner 10 by operation of the fan and drive motor assembly 30. The airstream with its entrained dirt and debris passes through the airstream conduit 90 which connects the inlet cavity 32 with the passageway 54 and delivery port 49 forming the inlet flow passageway (note action arrow A). The airstream with entrained dirt and debris is then directed by the delivery port 49 tangentially along the sidewall 44 of the collection chamber 28. The airstream flows like a vortex in a spiral path around the sidewall 44 (note action arrow B in FIGS. 3 and 5). The heaviest dirt and debris is moved by centrifugal force toward the sidewall 44 and under the influence of gravity passes downward through the gap between the outer edge of the prefilter 84 and the sidewall 44 to the bottom wall 42 of the dirt container 26. The heavier dirt and debris collects in the annular portion of the collection chamber 28 beneath the prefilter 84 on the bottom wall 42.

The airstream, now without the heavier dirt and debris held by gravity and the prefilter 84 in the lower portion of the dirt container 26, passes upwardly in the collection chamber 28 along the discharge conduit 60 (note action arrows C). More specifically the airstream flows through the airflow passageways 86 in the face 88 of the prefilter 84 toward the pleated filter material 72 (note action arrows C). This upward movement of the now partially cleaned airstream occurs well inside the entering vortex airflow established by the delivery port 49. As such, the airstream moves efficiently with minimal turbulence and without any appreciable loss of cleaning power. The airstream is then drawn by the fan and drive motor assembly 30 through the pleated filter material 72 which allows the passage of air but prevents the passage of any relatively small particles of dirt and debris remaining in the airstream. The airstream then passes downwardly through the discharge conduit 60 and out the discharge port 58 (note action arrow D).

From there, the airstream is drawn through a filter (not shown) formed, for example, from a pad of foam rubber into the canister assembly compartment holding the fan and drive motor assembly 30. From this point the airstream passes over the motor of the fan and drive motor assembly 30, thereby providing some cooling to the motor. The airstream is then exhausted through a filter, such as a HEPA filter (not shown) and a discharge vent 92 into the environment.

The foregoing description of one embodiment of this invention has been presented for purposes of illustration and description. It is not intended to be exhaustive or to limit the invention to the precise form disclosed. Obvious modifications or variations are possible in light of the above teachings. For example, while only one agitator 34 is shown, multiple co-rotating or counter-rotating agitators could be provided. If desired, a performance indicator of the type presently found on the Kenmore Model 38912 upright vacuum cleaner could be provided in the airstream conduit to give a true indication of vacuum cleaner performance. Additionally, while the dirt container 26 is illustrated as being carried in a cavity 24 in the canister assembly 14, it should be appreciated that it could also be mounted in a cavity or by means of some other structure on the nozzle assembly 12 if desired. Further, while not illustrated, it should be appreciated that the dirt container 26 could be lined with a disposable bag if desired. When full of dirt and debris, the bag could simply be removed from the dirt container and it and the contents thereof disposed of in the garbage. A new bag could then be placed in the dirt container 26.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A vacuum cleaner, comprising:

a housing including a nozzle assembly and a canister assembly;

a dirt container connected to said housing, said dirt container having a side wall and including a collection chamber and a handle defining an inlet flow passageway spaced from said sidewall;

an airstream conduit for conveying a vacuum airstream from said nozzle assembly to said inlet flow passageway; and a fan and motor assembly for generating said vacuum airstream and drawing dirt and debris through said airstream conduit and said inlet flow passageway into said collection chamber.

2. The vacuum cleaner of claim 1, wherein said dirt container is connected to said canister assembly.

3. The vacuum cleaner of claim 1, wherein said inlet flow passageway includes a delivery port in communication with said collection chamber.

4. The vacuum cleaner of claim 3, wherein said collection chamber is substantially cylindrical in shape and said delivery port is oriented substantially tangentially with respect to said collection chamber.

5. The vacuum cleaner of claim 1, wherein said dirt container includes a filter and a discharge outlet.

6. The vacuum cleaner of claim 5, wherein said dirt container further includes a prefilter extending at least partially across said collection chamber between said filter and a floor of said dirt container.

7. The vacuum cleaner of claim 6, wherein said prefilter includes at least one airflow passageway in a face of said prefilter between an inner edge and an outer edge thereof.

8. A dirt container for a vacuum cleaner, comprising:

a housing having a sidewall and including a dirt collection chamber; and a handle defining an inlet flow passageway spaced from said sidewall and wherein said dirt container further includes a prefilter extending at least partially across said collection chamber.

9. The dirt container of claim 8, wherein said dirt collection chamber is substantially cylindrical in shape.

10. The dirt container of claim 9, wherein said inlet flow passageway includes a delivery port oriented substantially tangentially and in fluid communication with said dirt collection chamber.

11. The dirt container of claim 8, wherein said prefilter includes at least one airflow passageway in a face of said prefilter between an inner edge and an outer edge thereof.

* * * * *